United States Patent [19]

Lipsitz et al.

[11] 4,314,423

[45] Feb. 9, 1982

[54] SOUND PRODUCING TOY

[76] Inventors: Barry R. Lipsitz, 44 Purdy Rd., E., Norwalk, Conn. 06850; Kevin O. Dolinar, 317H. Hunting Creek Rd., Canonsburg, Pa. 15317

[21] Appl. No.: 55,822

[22] Filed: Jul. 9, 1979

[51] Int. Cl.[3] ..... A63H 23/10; A01M 31/06; A63H 5/00

[52] U.S. Cl. ..... 46/232; 46/92; 340/384 E; 43/3

[58] Field of Search ..... 43/2, 3; 46/232, 92, 46/93, 228, 227, 117; 200/61.05, 61.01; 119/29; 179/1 VC; 340/384 E

[56] References Cited

U.S. PATENT DOCUMENTS

| | | | |
|---|---|---|---|
| 1,490,185 | 4/1924 | Ross | 46/232 X |
| 1,814,837 | 7/1931 | Leiber | 46/93 |
| 2,003,765 | 6/1935 | Widen | 46/232 X |
| 2,835,064 | 5/1958 | Webb | 43/3 |
| 3,103,762 | 9/1963 | Glass et al. | 46/232 X |
| 3,190,038 | 6/1965 | Kardon | 46/117 X |
| 3,274,729 | 9/1966 | Refabert | 46/232 X |
| 3,469,039 | 9/1969 | Lee | 46/232 X |
| 3,594,786 | 7/1971 | Brunner-Schwer | 340/384 E |
| 3,683,113 | 8/1972 | Stewart | 340/384 E X |
| 3,689,927 | 9/1972 | Boston | 43/3 X |
| 3,912,694 | 10/1975 | Chrappe et al. | 46/232 X |
| 4,056,890 | 11/1977 | Dembski | 43/3 |

FOREIGN PATENT DOCUMENTS

| | | | |
|---|---|---|---|
| 2338094 | 2/1975 | Fed. Rep. of Germany | 43/2 |

*Primary Examiner*—Gene Mancene
*Assistant Examiner*—Michael J. Foycik

[57] ABSTRACT

A toy animal or object embodies a sound emitting system to produce a sound characteristic of the animal or object represented. The sound emitting system has electronic sound generating circuitry and an actuator. The actuator is responsive to water to turn on the electronic sound generating circuitry for production of the sound.

10 Claims, 3 Drawing Figures

SOUND PRODUCING TOY

DISCLOSURE OF THE INVENTION

The present invention relates to the class of toys or novelty items which simulate the sound of an animal or object. More particularly, a group of toys is disclosed in which each toy represents a specific animal or sound producing object and in which each toy simulates the sound normally produced by the animal or object. The sound is produced by the toy only when it is placed in an environment characteristic of the environment in which the real-life animal or object is found. An electronic circuit in the toy is used to produce the sound. The circuit may be powered by a battery or other means, such as a solar cell. Depending upon the environment in which the toy is to emit its sound, a particular sensor is used. A photocell, for example, may be used to trigger the circuit to produce an appropriate sound for a toy representative of an animal or object which makes the sound only in the light. Similarly, a pair of probes between which current is conducted when the probes are immersed in water may be used to trigger the circuit to produce its sound for a toy representative of an animal or object which normally functions in water. It will be understood that the object may be so constructed that its surface may serve as one of the probes.

An example of a toy to which the present invention may be applied is a toy duck which makes a quacking sound when placed in water. In the past, toy ducks have been used which float in water and are enjoyed by a child while bathing. Such toy ducks either made no noise at all or made noises unrelated to the actual sound made by living ducks. Further, such prior toy ducks which did make noise were not activated by water to make the noise electronically; rather, they were, for example, squeezed to make a high pitched whistle.

The present invention uses an electronic circuit which is activated by an environment sensing device to produce a desired sound. The circuit and sensing device are hidden within the toy animal or object. For the purposes of this disclosure, the present invention will be described as applied to a toy duck. It is emphasized that the teachings of this invention may be applied to many other toy or novelty items; for example, a toy cricket, frog, woodpecker, mouse, chipmunk, songbird, cat, dog, cow, horse or the like could be manufactured. Also, a toy steamboat which makes a motor sound and periodically "toots" when placed in water can be fabricated using the teachings of the present invention. Other types of devices and toys will become apparent to the worker skilled in the art.

In accordance with the present invention a toy or novelty device embodies a sound emitting system. The sound emitting system produces a sound characteristic of an animal or object and comprises electronic sound generating means and trigger means to initiate the sound. The trigger means is responsive to an environment characteristic of the animal or object.

A more complete understanding of the invention and the various objects and features thereof can be had by reference to the following description of one embodiment thereof (i.e., a toy duck) when considered in connection with the accompanying drawings, wherein.

Figure 1:
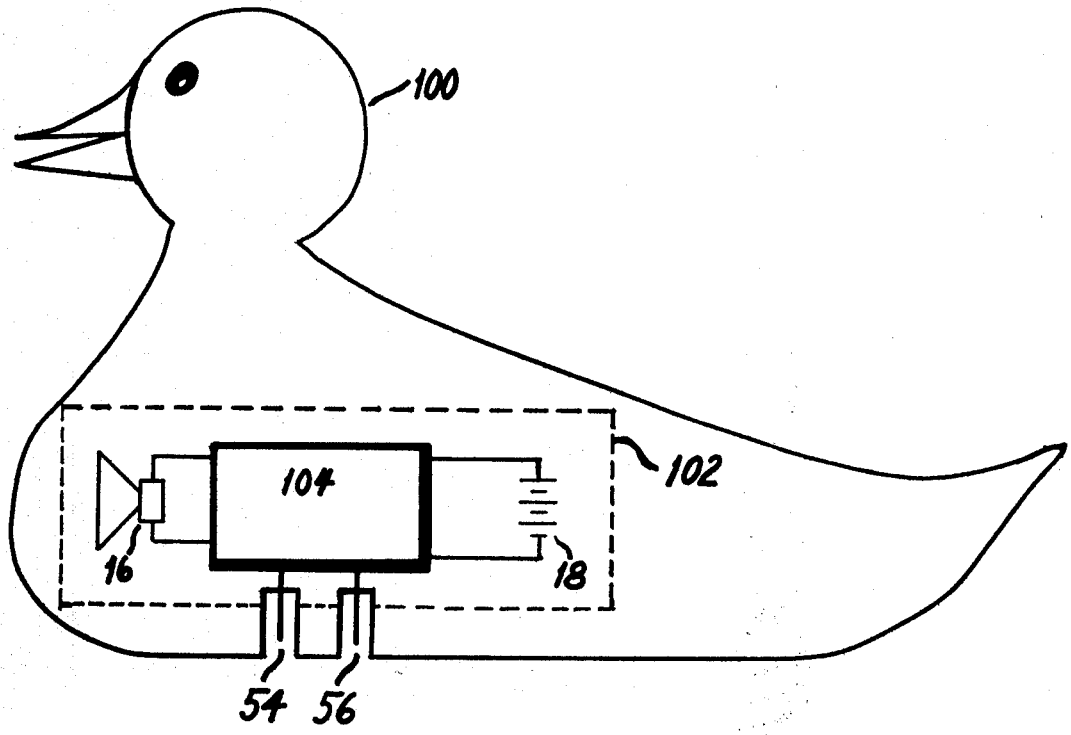
FIG. 1 is a sketch of a toy duck showing an electronic device contained therein.

As shown in FIG. 1, a sound emitting system 102 is hidden inside a toy duck 100. The toy duck may be molded of plastic or manufactured from any other suitable material. Preferably, toy duck 100 will float on water and will be waterproof in the sense that the sound emitting system will be kept dry when the toy duck is placed in water. Sound emitting system 102 comprises an output transducer (e.g. speaker) 16, an electronic circuit 104, a power source (e.g. a battery) 18, and probes 54 and 56 which act as a sensor to trigger the system to produce a "quack" sound when the toy is placed in water.

Figure 2:
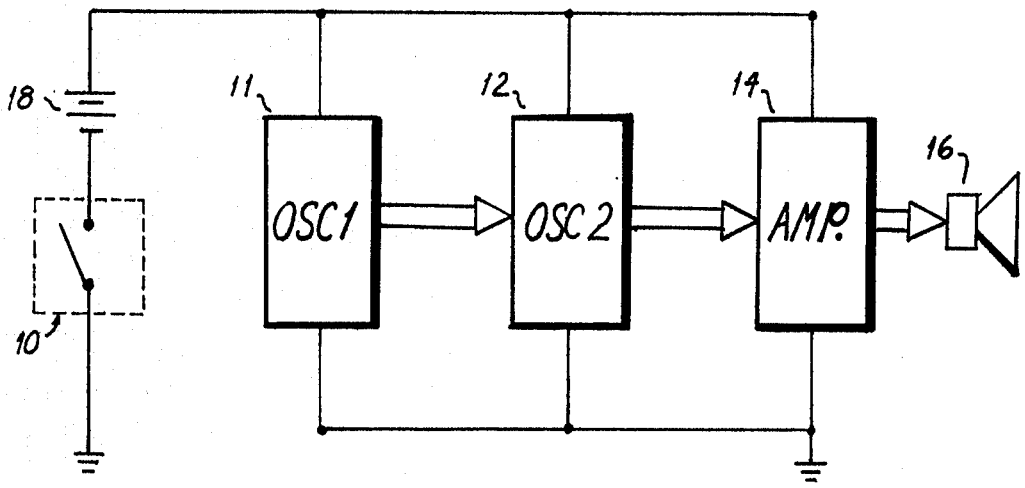
FIG. 2 is a block diagram for an electronic circuit to produce a sound in accordance with the present invention.

As shown in FIG. 2, an electronic circuit which can be used for the sound emitting system includes a first oscillator 11 the output of which is fed into a second oscillator 12 such that the output of oscillator 12 is modulated by oscillator 11 to produce a desired sound. A virtually infinite number of sounds can be produced selectively by controlling the frequency and amplitude of interacting oscillators 11 and 12. An audio amplifier 14 is used to drive output transducer 16. Trigger means 10 is used to activate the sound system by supplying power to the electronic circuit from power source 18 when the toy is placed in an appropriate environment.

Figure 3:
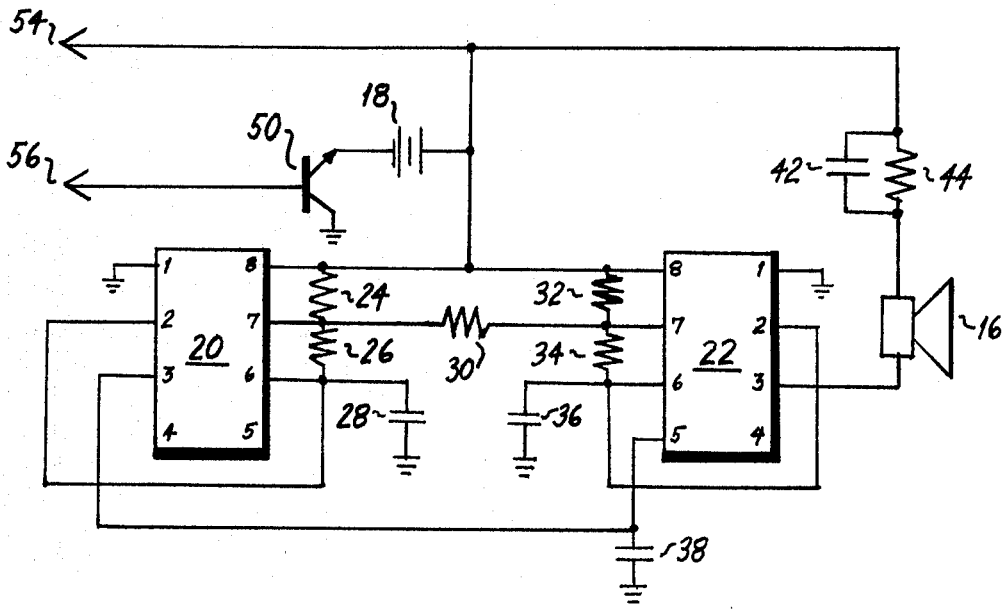
FIG. 3 is a schematic diagram of an electronic circuit to produce a sound in accordance with the present invention.

An example of a trigger means is illustrated by elements 54, 56, and 50 of FIG. 3. Probes 54 and 56 are arranged within the toy so that a conductive path through water will exist between them when the toy is placed in water. This is shown in FIG. 1. Transistor 50 is biased such that it will turn on (i.e., a collector-emitter junction rendered conductive) when a conductive path through water is provided between probes 54 and 56. Turning on transistor 50 provides power to the circuit from battery 18. Integrated circuits 20 and 22, along with their respective components 24,26,28 and 32,34,36 form individual oscillators. A commonly available timer circuit such as the LM555 manufactured by National Semiconductor or its equivalent may be used for circuit elements 20 and 22. The values of resistors 24,26,32, and 34 along with the values of capacitors 28 and 36 will determine the specific sound produced by the circuit. Capacitor 38 serves as a filter in the input to the second oscillator. The parallel combination of capacitor 42 and resistor 44 function in the audio output circuit wherein speaker 16 is driven by the output of integrated circuit 22.

If a substitute trigger means is desired, probes 54 and 56 may be replaced by a suitable sensor. A photodarlington transistor, for example, may be used to activate the circuit in the presence of light. Any of the various magnetic, temperature, pressure, or inertial sensors or the like known to those skilled in the art may also be used depending upon the particular environment in which it is desired to have the toy or novelty device be activated. The trigger means may also serve to activate functions other than sound.

The above described arrangement is merely illustrative of the principles of the present invention. Numerous modifications and adaptations thereof will be readily apparent to those skilled in the art without departing from the spirit and scope of the present invention.

We claim:

1. A sounding toy comprising:

electronic sounding means including an electronic circuit connected to a transducer;

means for supporting said sounding means, said support means having a bottom surface and including a watertight container for keeping said sounding means dry while floatedly supported on water;

electrical current supplying means located within said container for providing current to said electronic circuit; and a water-activated switch for activating said electronic circuit to produce a sound when said bottom surface is placed in water and to stop producing said sound when said bottom surface is removed from water, said switch including probe means electrically connected to said current supplying means and protruding in watertight relation through said bottom surface.

2. The toy of claim 1 wherein said sounding means generates a predetermined sound having a periodic waveform comprising a plurality of frequencies.

3. The toy of claim 2 wherein said electronic circuit comprises first and second oscillators, the output of said first oscillator being electrically coupled to said second oscillator to modulate the output of said second oscillator.

4. The toy of claim 1 wherein said bottom surface has at least one cavity therein and said probe means is contained within said cavity.

5. The toy of claim 1 wherein said support means is in the shape of a duck.

6. The toy of claim 5 wherein said sounding means produces a quack sound.

7. The toy of claim 1 wherein said support means is in the shape of a frog.

8. The toy of claim 7 wherein said sounding means produces a croaking sound.

9. The toy of claim 4 wherein said support means is in the shape of a duck and said sounding means produces a quack sound.

10. The toy of claim 4 wherein said support means is in the shape of a frog and said sounding means produces a croaking sound.

* * * * *

UNITED STATES PATENT AND TRADEMARK OFFICE

CERTIFICATE OF CORRECTION

PATENT NO. : 4,314,423

DATED : February 9, 1982

INVENTOR(S) : Barry R. Lipsitz and Kevin D. Dolinar

It is certified that error appears in the above—identified patent and that said Letters Patent is hereby corrected as shown below:

In the inventor's names, change "Kevin O. Dolinar" to -- Kevin D. Dolinar --.

Signed and Sealed this

*Eighteenth* Day of *May 1982*

[SEAL]

*Attest:*

GERALD J. MOSSINGHOFF

*Attesting Officer*

*Commissioner of Patents and Trademarks*